US010490945B2

(12) United States Patent
Bergner et al.

(10) Patent No.: US 10,490,945 B2
(45) Date of Patent: Nov. 26, 2019

(54) CONTACT ASSEMBLY AND METHOD FOR REDUCING CROSS-TALK

(71) Applicant: TE Connectivity Germany GmbH, Bensheim (DE)

(72) Inventors: Bert Bergner, Bensheim (DE); Carlos Almeida, Reinheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/915,570

(22) Filed: Mar. 8, 2018

(65) Prior Publication Data

US 2018/0198238 A1 Jul. 12, 2018

Related U.S. Application Data

(63) Continuation of application No. PCT/EP2016/071381, filed on Sep. 9, 2016.

(30) Foreign Application Priority Data

Sep. 10, 2015 (DE) ..... 10 2015 217 277

(51) Int. Cl.
*H01R 13/64* (2006.01)
*H01R 13/6463* (2011.01)
(Continued)

(52) U.S. Cl.
CPC ..... *H01R 13/6463* (2013.01); *H01R 12/724* (2013.01); *H01R 13/6464* (2013.01)

(58) Field of Classification Search
CPC ..... H01R 13/6463; H01R 12/274; H01R 13/6464
See application file for complete search history.

(56) References Cited

U.S. PATENT DOCUMENTS 5,547,405 A * 8/1996 Pinney ..... H01R 13/6625 439/676
RE38,519 E * 5/2004 Doorhy ..... H01R 4/2433 439/404
(Continued)

FOREIGN PATENT DOCUMENTS

GB 2343558 A 5/2000
JP 2002-529894 A 9/2002
(Continued)

OTHER PUBLICATIONS

PCT Notification, International Search Report and the Written Opinion of the International Searching Authority, dated Nov. 28, 2016, 13 pages.
(Continued)

*Primary Examiner* — Alexander Gilman
(74) *Attorney, Agent, or Firm* — Barley Snyder

(57) ABSTRACT

A contact assembly comprises a first pair of contact elements connected to a first pair of signal lines in a first connector, a second pair of contact elements connected to a second pair of signal lines in a second connector, and a first electrical arrangement connecting a first contact element of the first pair of contact elements and the first contact element of the second pair of contact elements. A second contact element of the first pair of contact elements and a first contact element of the second pair of contact elements are positioned adjacent one another. A capacitance of the first electrical arrangement corresponds to a capacitance between the second contact element of the first pair of contact elements and the first contact element of the second pair of contact elements.

15 Claims, 8 Drawing Sheets

(51) Int. Cl.
*H01R 12/72* (2011.01)
*H01R 13/6464* (2011.01)

(56) References Cited

U.S. PATENT DOCUMENTS 7,182,649 B2 * 2/2007 Caveney ..... H05K 1/0228 439/620.22
7,317,318 B2 * 1/2008 Jackson ..... H01R 13/6464 324/538
8,403,709 B2 * 3/2013 Hammond, Jr. ..... H01R 13/719 439/676
8,801,473 B2 * 8/2014 Fransen ..... H01R 13/6467 439/676
9,379,492 B2 6/2016 Zebhauser et al.
10,074,938 B2 * 9/2018 Murray ..... H05K 1/0228
2002/0019172 A1 * 2/2002 Forbes ..... H01R 13/6464 439/676
2004/0082227 A1 * 4/2004 Hashim ..... H01R 13/6464 439/676
2004/0184247 A1 * 9/2004 Adriaenssens ..... H05K 1/0228 361/766
2005/0181676 A1 * 8/2005 Caveney ..... H05K 1/0228 439/676
2005/0253662 A1 * 11/2005 Seefried ..... H05K 1/0228 333/1
2005/0254223 A1 * 11/2005 Hashim ..... H05K 1/0228 361/793
2011/0136382 A1 * 6/2011 Jaouen ..... H01R 13/6464 439/620.01
2015/0132994 A1 * 5/2015 Zebhauser ..... H01R 12/724 439/607.06

FOREIGN PATENT DOCUMENTS

JP 2004-146078 A 5/2004
JP 2011-192512 A 9/2011
WO 2014023386 A1 2/2014

OTHER PUBLICATIONS

Pinouts.Ru Team: "Ethernet 10/100/1000 Mbit RJ45 wiring diagram and cable pinout", May 20, 2014, XPO55322819, Retrieved from the Internet: URL:http://pinouts.ru/visual/ethernet_10_100_1000.jpg (retrived on Nov. 24, 2016), 1 page.
Japanese Notice of Reasons for Refusal with English translation, Japanese Patent Application No. 2018-530971, dated Mar. 20, 2019, 7 pages.
Abstract of JP 2004-146078 A, dated May 20, 2004, 1 page.
Abstract of JP 2011-192512 A, dated Sep. 29, 2011, 1 page.
Japanese Notice of Reasons for Refusal with English translation, Japanese Patent Application No. 2018-530971, dated Sep. 10, 2019, 5 pages.

* cited by examiner

CONTACT ASSEMBLY AND METHOD FOR REDUCING CROSS-TALK

CROSS-REFERENCE TO RELATED APPLICATIONS

This application is a continuation of PCT International Application No. PCT/EP2016/071381, filed on Sep. 9, 2016, which claims priority under 35 U.S.C. § 119 to German Patent Application No. 102015217277.5, filed on Sep. 10, 2015.

FIELD OF THE INVENTION

The present invention relates to a contact assembly having a plurality of contact elements and, more particularly, to reducing cross-talk between the plurality of contact elements.

BACKGROUND

A known contact assembly includes a first connector and a second connector. The first connector has a pair of first contact elements contacting a first pair of signal lines and the second connector has a pair of second contact elements contacting a second pair of signal lines. A contact element of the pair of first contact elements is positioned adjacent a contact element of the pair of second contact elements.

In order to screen the pair of first contact elements from the pair of second contact elements to prevent cross-talk, screening elements such as screening plates are generally fitted between the two contact element pairs. These screening elements, however, take up space, and assembling the contact assembly is made more difficult as a result of the additional screening elements.

SUMMARY

A contact assembly comprises a first pair of contact elements connected to a first pair of signal lines in a first connector, a second pair of contact elements connected to a second pair of signal lines in a second connector, and a first electrical arrangement connecting a first contact element of the first pair of contact elements and the first contact element of the second pair of contact elements. A second contact element of the first pair of contact elements and a first contact element of the second pair of contact elements are positioned adjacent one another. A capacitance of the first electrical arrangement corresponds to a capacitance between the second contact element of the first pair of contact elements and the first contact element of the second pair of contact elements.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
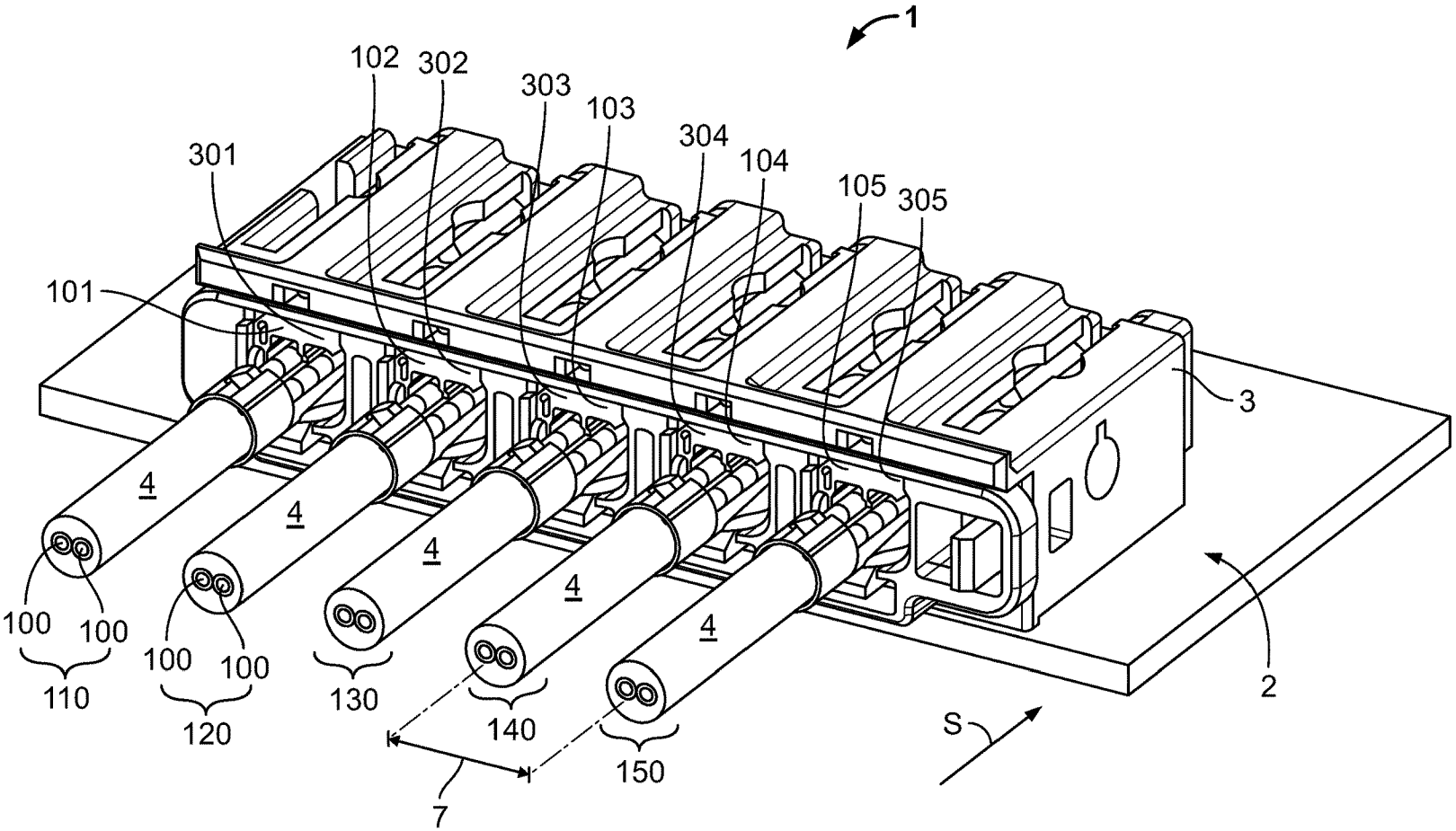
FIG. 1 is a perspective view of a contact assembly with a socket housing on a printed circuit board.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

A contact assembly 1 is shown in FIG. 1 with a socket housing 3. The socket housing 3 is disposed on a printed circuit board 2. The socket housing 3 has five connector receiving members 301, 302, 303, 304, 305 for receiving five connectors 101, 102, 103, 104, 105. The connectors 101, 102, 103, 104, 105 are each connected to cables 4 which each have two signal lines 100. It is desirable to minimize a spacing 7 between adjacent pairs of signal lines 100, for example, between a first pair 110 and a second pair 120 while still reducing cross-talk.

Figure 2:
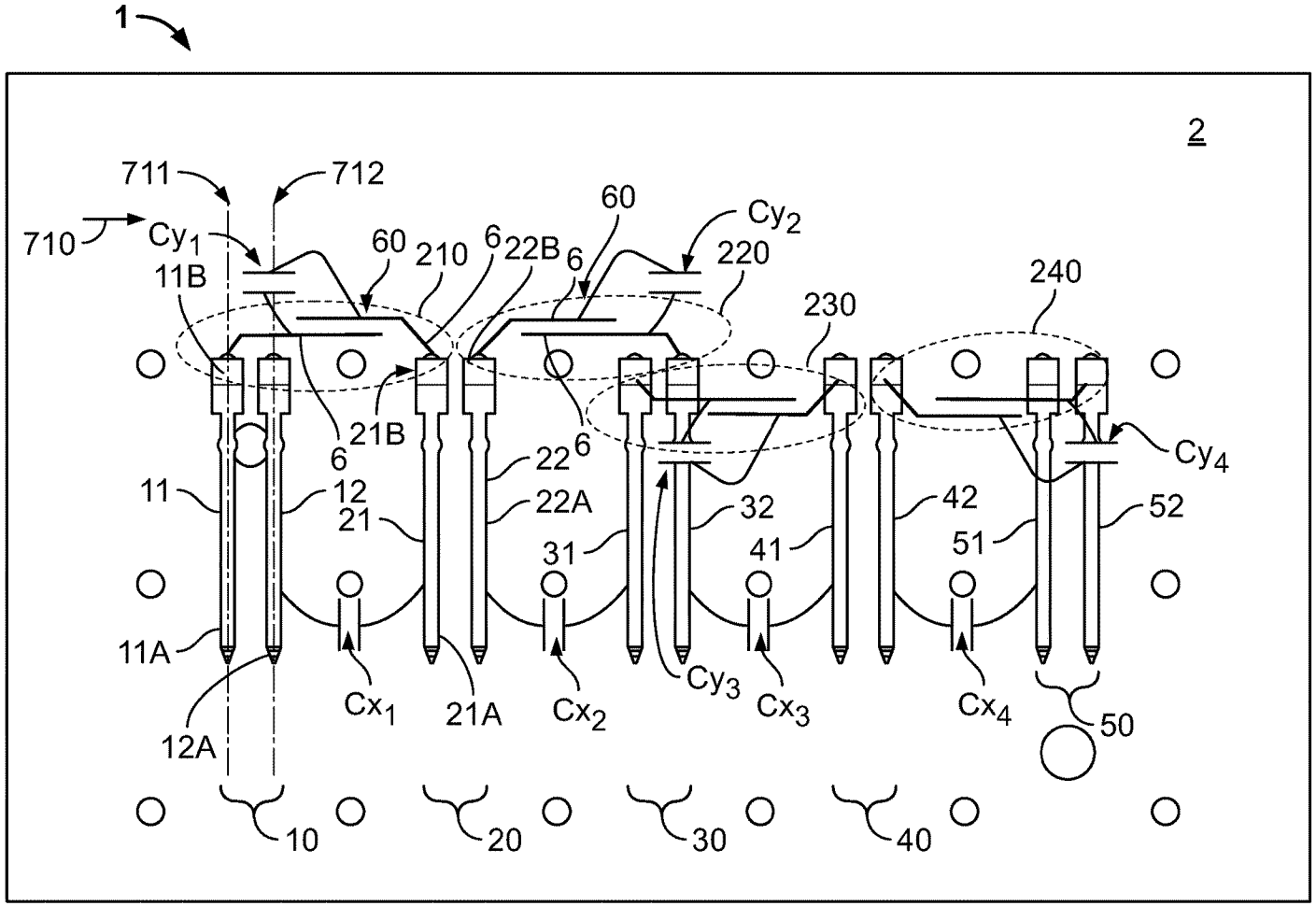
FIG. 2 is a schematic top view of a contact assembly according to an embodiment.
Figure 3:
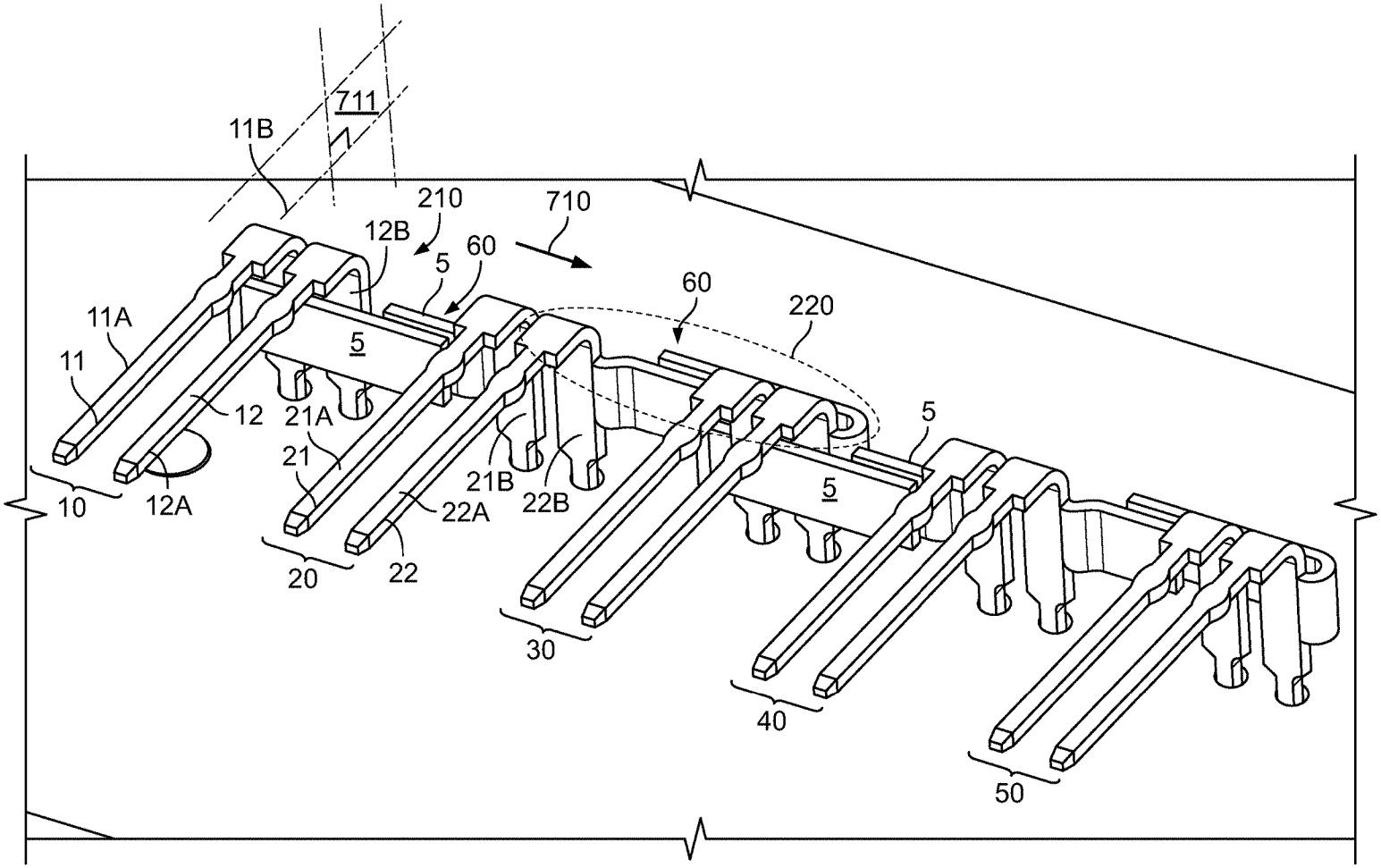
FIG. 3 is a front perspective view of a contact assembly according to another embodiment.
Figure 4:
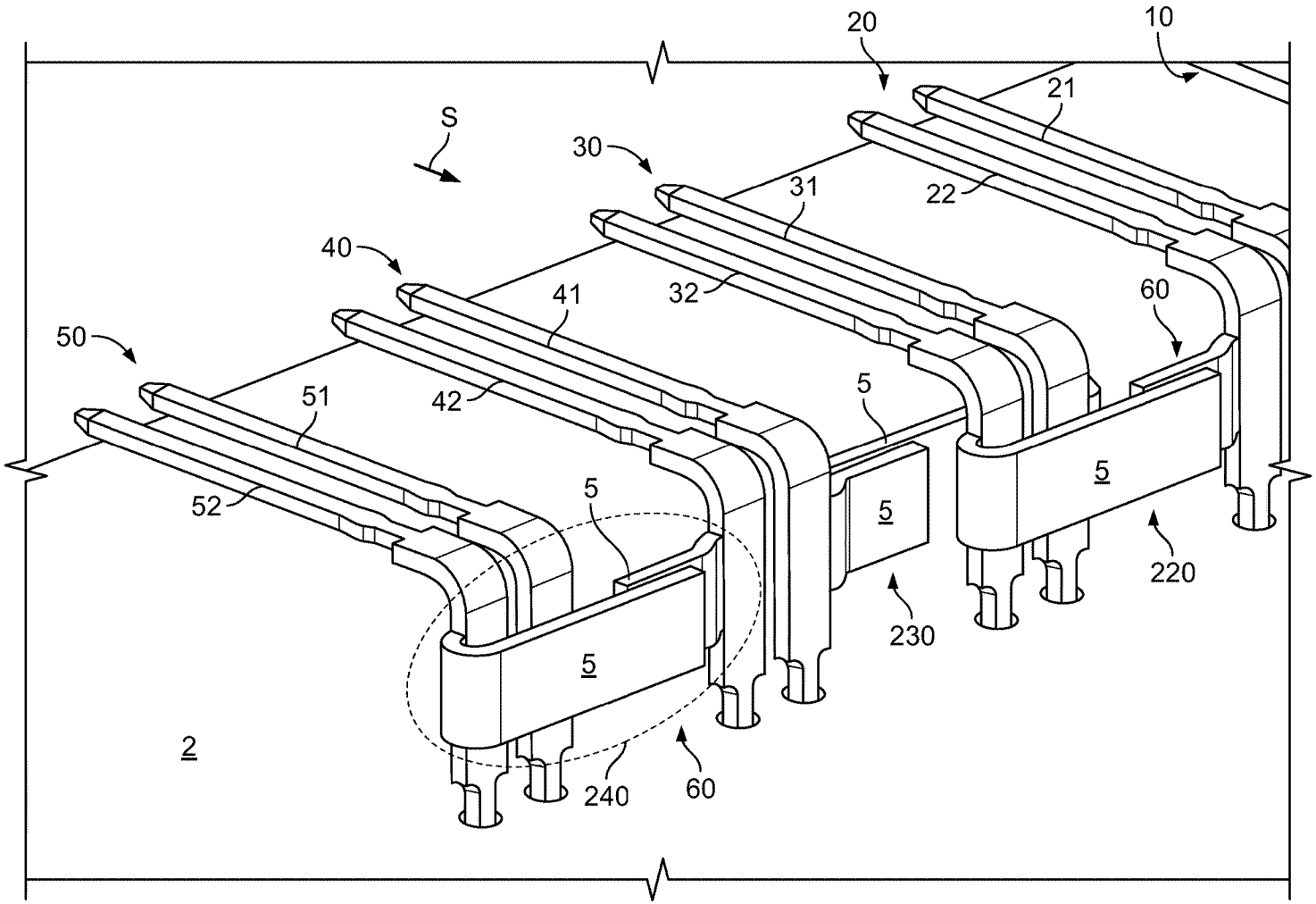
FIG. 4 is a rear perspective view of the contact assembly of FIG. 3.
Figure 5:
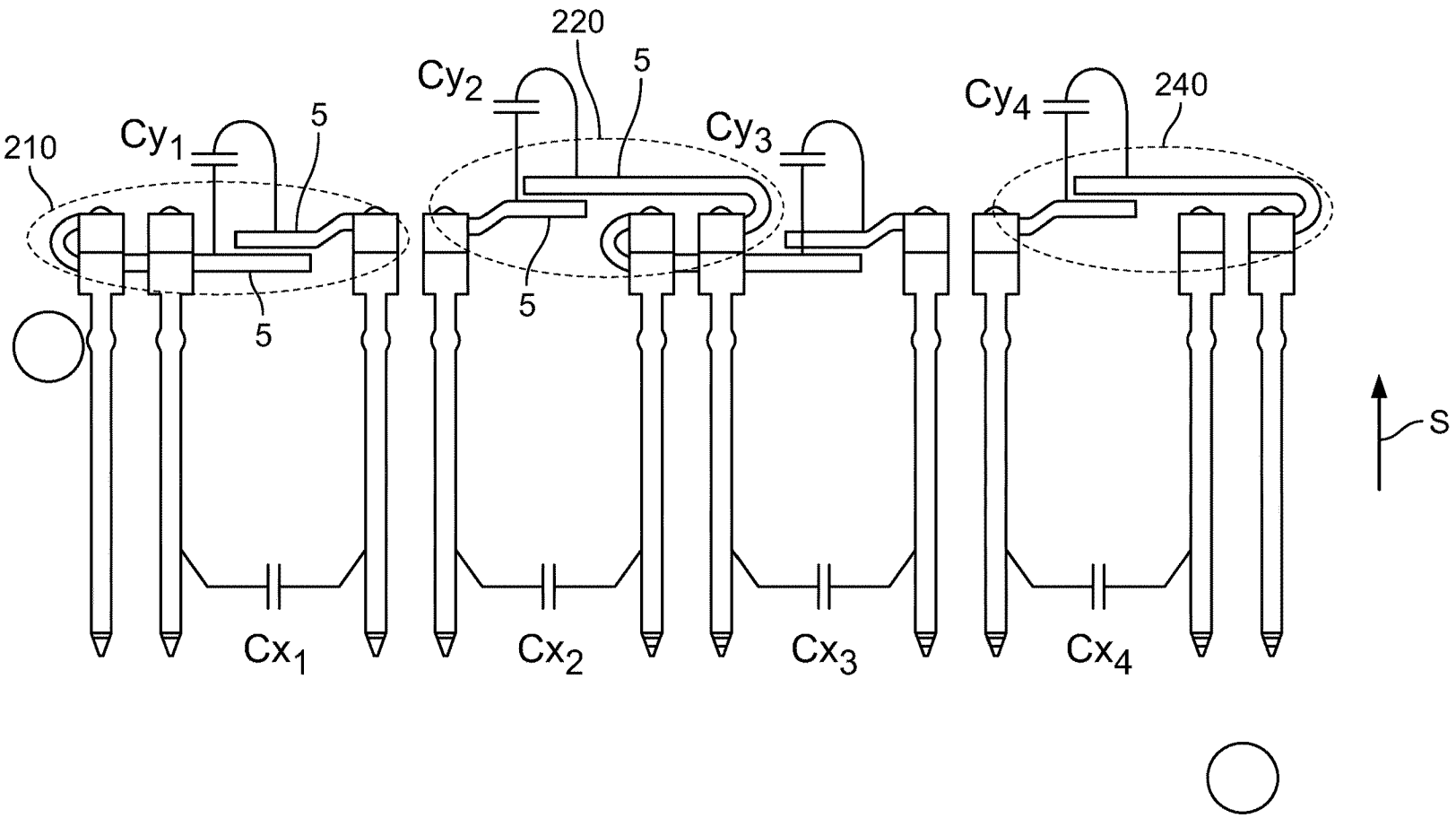
FIG. 5 is a top view of the contact assembly of FIG. 3.
Figure 6:
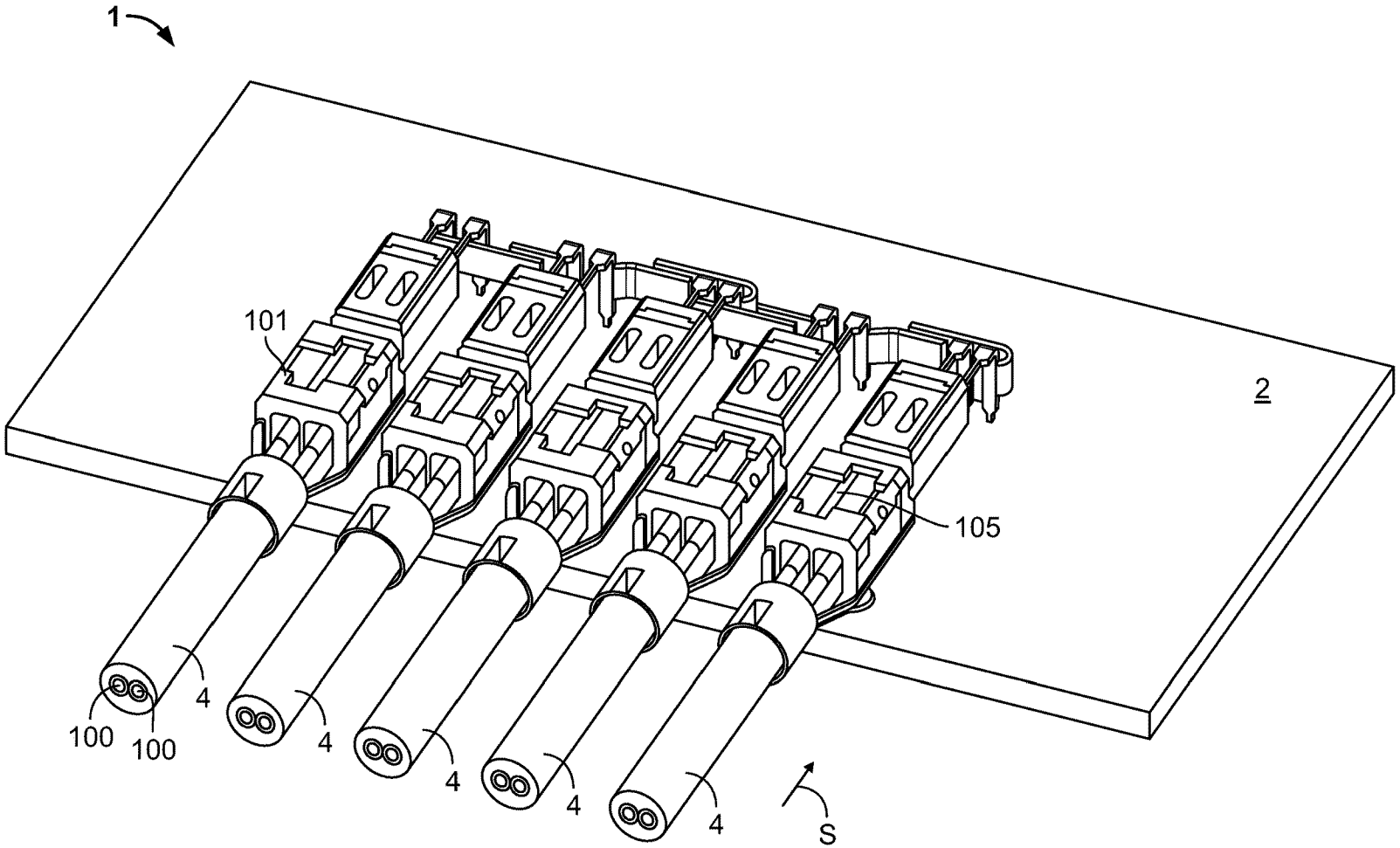
FIG. 6 is a perspective view of the contact assembly of FIG. 3 with the printed circuit board.

The contact assembly 1 according to an embodiment is shown in FIG. 2. The contact assembly 1 has a first contact element pair 10 having a first contact element 11 and a second contact element 12 and a second contact element pair 20 having a first contact element 21 and a second contact element 22. Cross-talk occurs in particular between the adjacent contact elements 12 and 21; these two contact elements 12, 21 constitute a type of capacitor having a first parasitic capacitance $Cx_1$. This is illustrated in FIG. 2 by a capacitor symbol, however, this illustration does not mean that an additional component is present and merely serves to provide a better understanding.

In order to compensate for the cross-talk which is caused by this first parasitic capacitance $Cx_1$, the first contact element 11 of the first contact element pair 10 is connected to the first contact element 21 of the second contact element pair 20 via an electrical arrangement 210. The capacitance $Cy_1$ of the electrical arrangement 210 corresponds to the capacitance $Cx_1$ between the second contact element 12 of the first contact element pair 10 and the first contact element 21 of the second contact element pair 20. When a signal is transmitted in a differential form between the first contact element 11 and the second contact element 12 of the first contact element pair 10, the cross-talk caused by the first contact element 21 of the second contact element pair 20 occurs not only in the second contact element 12 of the first contact element pair 10, but also to the same extent in the first contact element 11 of the first contact element pair 10. The two voltages in the contact elements 11 and 12 are changed to the same extent so that the two individual signals between the first contact element 11 and the second contact element 12 shift, but a difference therebetween remains the same and cross-talk is thereby compensated.

In a similar manner, cross-talk is prevented between the second contact element pair 20 and the third contact element pair 30. The second contact element 22 of the second contact element pair 20 is connected to the second contact element 32 of the third contact element pair 30 via a second electrical arrangement 220, whose capacitance $Cx_2$ is adapted to the capacitance $Cx_2$ between the second contact element 22 of the second contact element pair 20 and the first contact element 31 of the third contact element pair 30 and thereby compensates for it.

The cross-talk between the third contact element pair 30 and a fourth contact element pair 40 is also compensated for by a third electrical arrangement 230 connecting the first contact elements 31, 41. The fourth contact element pair 40 and a fifth contact element pair 50 are similarly connected via a fourth electrical arrangement 240 connecting the second contact elements 42, 52. In other embodiments, it is also possible for the contact assembly 1 to include additional contact element pairs, wherein the connection is brought about alternately between the first contact elements of adjacent contact element pairs and the second contact elements of adjacent contact element pairs.

The electrical arrangement 210, as shown in FIG. 2, includes strip conductors 6 arranged between the first contact element pair 10 and the second contact element pair 20 on the printed circuit board 2. These strip conductors 6 extend partially parallel with each other and are spaced apart from each other. They are opposite each other and form a capacitor 60 with a capacitance configured in such a manner that the entire capacitance $Cy_1$ of the electrical arrangement 210 is adapted to the capacitance $Cx_1$ between the second contact element 12 of the first contact element pair 10 and the first contact element 21 of the second contact element pair 20, as described above. The capacitance $Cy_1$ can be changed by the area of the overlap of the two portions of the strip conductors 6 extending parallel or the spacing between the two strip conductors 6 being increased or decreased. In other embodiments, the compensation via the electrical arrangement may also be carried out by other elements which are arranged on the printed circuit board 2, such as capacitors, if it is only desirable for current connectors or sockets to be able to be retained.

The electrical arrangement 210 extends in an extent direction 710 which extends perpendicularly to extent planes 711, 712 of the first contact element 11 and the second contact element 12 of the first contact element pair 10, respectively. A decoupling between the contact elements 11, 12 and the electrical arrangement 210 is thereby provided. The extent plane 711 of the contact element 11 is in this instance defined by a front portion 11A, the connection portion for connecting the cable 4, and a rear portion 11B which extends perpendicularly thereto. The rear portion 11B is the transmission portion of the contact element 11. Similarly, the extent plane 712 of the second contact element 12 is fixed.

Another embodiment of the contact assembly 1 is shown in FIGS. 3-6. Like reference numbers refer to like elements and only the differences with respect to the embodiment shown in FIG. 2 will be described in detail.

In the embodiment shown in FIGS. 3-6, the electrical arrangement 210 has two mutually opposing plate portions 5. A first plate portion 5 is integral with the first contact element 11 of the first contact element pair 10. A second plate portion 5 is integral with the first contact element 21 of the second contact element pair 20. In an embodiment, the plate portions 5 are each punched from a metal sheet together with the contact elements 11, 21; the combination of a contact element 11, 21 and a plate portion 5 is a single punched component.

The two plate portions 5 are each constructed to be planar, are opposite each other, and extend partially parallel with each other so that they form the capacitor 60. The capacitance of the capacitor 60 can be adjusted by the spacing between the two plate portions 5 and the length of the overlap between the plate portions 5 so that the capacitance $Cy_1$ of the electrical arrangement 210 which connects the first contact element 11 of the first contact element pair 10 to the first contact element 21 of the second contact element pair 20 corresponds to the capacitance $Cx_1$ between the second contact element 12 of the first contact element pair 10 and the first contact element 21 of the second contact element pair 20.

The electrical arrangements 210, 220, etc., again extend in an extent direction 710 which extends perpendicularly relative to the extent directions 711, 712, etc., of the contact elements 11, 12, etc., in order to achieve a good decoupling between the contact elements 11, 12, etc., and the electrical arrangements 210, 220, etc.

Figure 7:
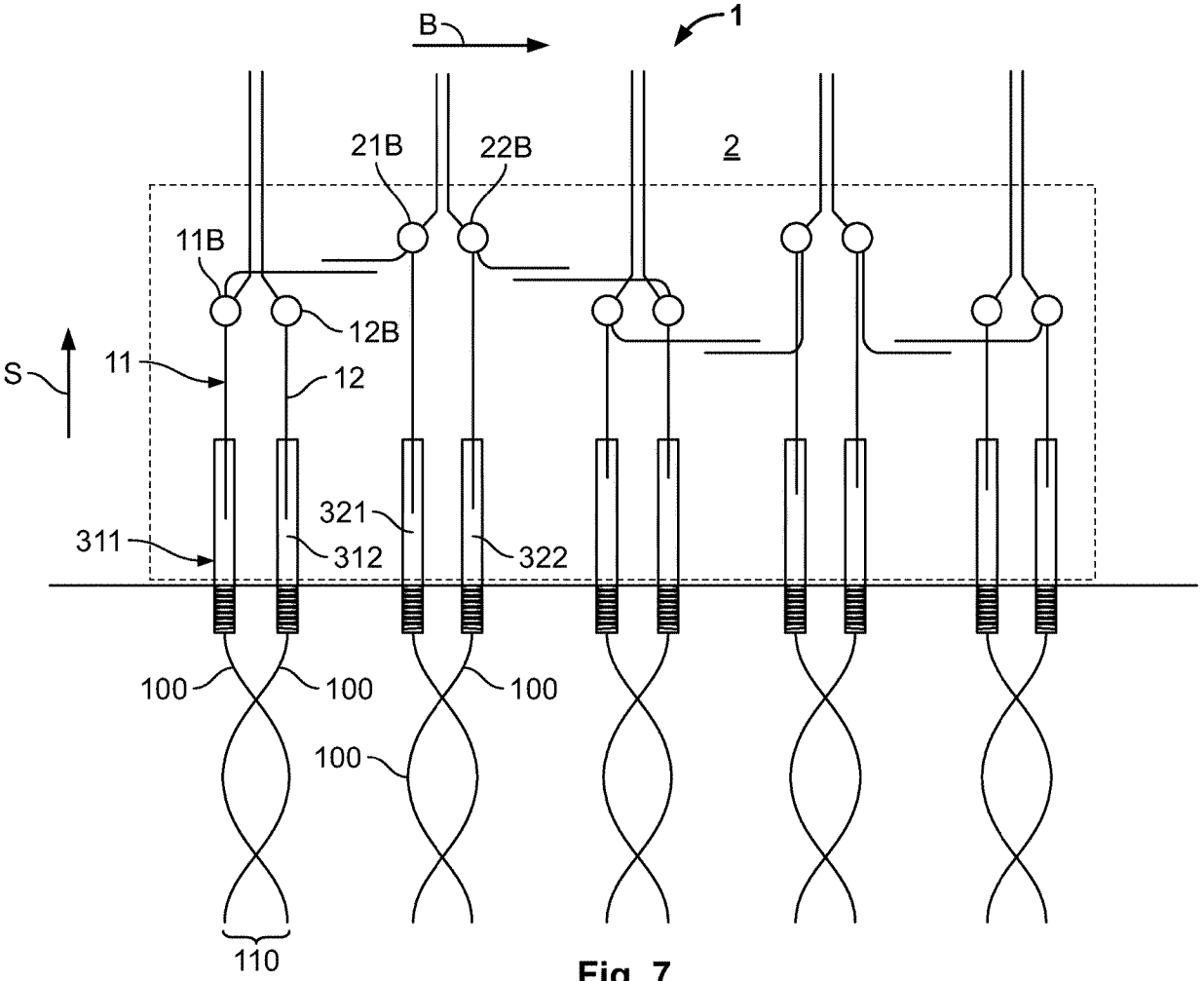
FIG. 7 is a schematic top view of a contact assembly according to another embodiment.

Another embodiment of the contact assembly 1 is shown in FIG. 7. Like reference numbers refer to like elements and only the differences with respect to the embodiments above will be described in detail.

The transmission portions 11B, 12B of the contact elements 11, 12 of the first contact element pair 10 in the embodiment of FIG. 7 are offset relative to the transmission portions 21B, 22B of the contact elements 21, 22 of the second contact element pair 20 with respect to the insertion direction S. At least in those portions, the spacing between the two contact element pairs 10, 20, in particular the spacing between the second contact element 12 of the first contact element pair 10 and the second contact element 21 of the second contact element pair 20 is thereby increased without increasing a width of the contact assembly 1 as measured in the width direction B. In this case, the width direction B extends perpendicularly to the insertion direction S and parallel with the direction of the printed circuit board 2. As a result of the increased spacing, the contact elements 12, 21 influence each other to a lesser extent. The transmission portions 11B, 12B, 21B, 22B extend in this instance perpendicularly to the insertion direction S. In another embodiment, they may also extend obliquely thereto or parallel therewith.

The contact elements 11, 12, 21, 22, as shown in FIG. 7, are received in corresponding, schematically illustrated receiving members 311, 312, 321, 322. The signal lines 100 extend away from these receiving members 311, 312, 321, and 322 at the contact assembly 1 in a twisted manner in order to apply interference signals uniformly to the two signal lines 100.

Figure 8:
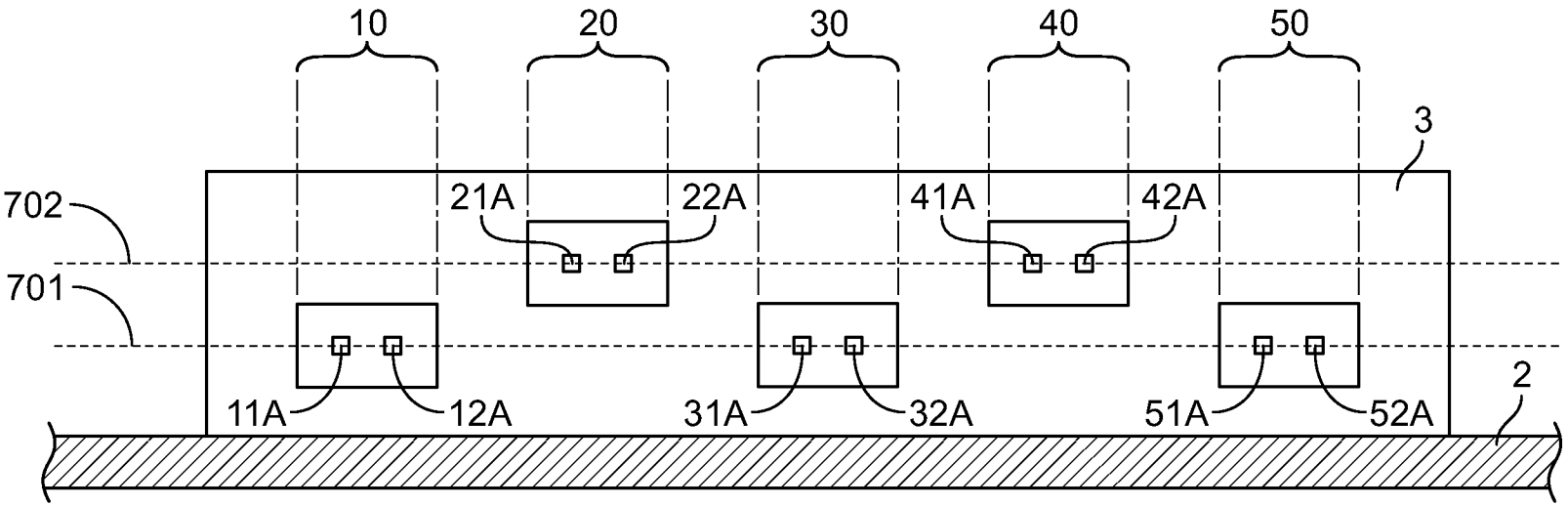
FIG. 8 is a schematic front view of a contact assembly according to another embodiment.

Another embodiment of the contact assembly 1 is shown in FIG. 8. Like reference numbers refer to like elements and only the differences with respect to the embodiments above will be described in detail.

In the embodiments of FIG. 8, the connection portions 11A, 12A, 31A, 32A, 51A, 52A of the contact elements 11, 12, 31, 32, 51, 52 extend in a first plane 701. That first plane is parallel with the plane of the printed circuit board 2. The connection portions 21A, 22A, 41A, 42A of the contact elements 21, 22, 41, 42 are located in a second plane 702 which is parallel with the first plane 701 but is offset relative thereto. An increase of the spacing between portions of contact element pairs 10, 20, 30, 40, 50 which are adjacent in each case is also thereby achieved, for example, between the first contact element pair 10 and the second contact element pair 20, by means of which the coupling between the individual contact element pairs 10, 20, 30, 40, 50 is smaller.

What is claimed is:

1. A contact assembly, comprising:

a first pair of contact elements connected to a first pair of signal lines in a first connector;

a second pair of contact elements connected to a second pair of signal lines in a second connector, a second contact element of the first pair of contact elements and a first contact element of the second pair of contact elements are positioned adjacent one another; and a first electrical arrangement connecting a first contact element of the first pair of contact elements and the first contact element of the second pair of contact elements, a capacitance of the first electrical arrangement corresponds to a capacitance between the second contact element of the first pair of contact elements and the first contact element of the second pair of contact elements, the first electrical arrangement includes a first portion extending from the first contact element of the first pair of contact elements and a second portion extending from the first contact element of the second pair of contact elements, the first portion overlaps the second portion in a direction extending parallel to an insertion direction of the contact elements.

2. The contact assembly of claim 1, further comprising a printed circuit board, the first portion and the second portion of the first electrical arrangement are a plurality of strip conductors disposed on the printed circuit board.

3. The contact assembly of claim 1, wherein the first portion and the second portion of the first electrical arrangement are a pair of plate portions disposed opposite one another.

4. The contact assembly of claim 3, wherein the pair of plate portions are integral with the first contact element of the first pair of contact elements and the first contact element of the second pair of contact elements.

5. The contact assembly of claim 1, wherein the first electrical arrangement extends along an extent direction perpendicular to an extent plane in which at least one of the first contact element of the first pair of contact elements and the first contact element of the second pair of contact elements extends.

6. The contact assembly of claim 1, wherein each of the contact elements of the first pair of contact elements and the second pair of contact elements has a transmission portion.

7. The contact assembly of claim 6, wherein the transmission portions of the first contact element and the second contact element of the first pair of contact elements are offset in the insertion direction of the contact elements relative to the transmission portions of the first contact element and the second contact element of the second pair of contact elements.

8. The contact assembly of claim 1, wherein each of the contact elements of the first pair of contact elements and the second pair of contact elements has a connection portion.

9. The contact assembly of claim 8, wherein the connection portions of the first contact element and the second contact element of the first pair of contact elements are disposed in a first plane and the connection portions of the first contact element and the second contact element of the second pair of contact elements are disposed in a second plane offset relative to the first plane.

10. The contact assembly of claim 1, further comprising a third pair of contact elements connected to a third pair of signal lines in a third connector, a first contact element of the third pair of contact elements and a second contact element of the second pair of contact elements are positioned adjacent one another.

11. The contact assembly of claim 10, further comprising a second electrical arrangement connecting the second contact element of the second pair of contact elements and a second contact element of the third pair of contact elements, a capacitance of the second electrical arrangement corresponds to a capacitance between the second contact element of the second pair of contact elements and the first contact element of the third pair of contact elements.

12. The contact assembly of claim 11, further comprising a fourth pair of contact elements connected to a fourth pair of signal lines in a fourth connector, a first contact element of the fourth pair of contact elements and the second contact element of the third pair of contact elements are positioned adjacent one another.

13. The contact assembly of claim 12, further comprising a third electrical arrangement connecting the first contact element of the third pair of contact elements and the first contact element of the fourth pair of contact elements, a capacitance of the third electrical arrangement corresponds to a capacitance between the second contact element of the third pair of contact elements and the first contact element of the fourth pair of contact elements.

14. The contact assembly of claim 1, wherein the first portion and the second portion are spaced apart from each other in the direction extending parallel to the insertion direction.

15. A method for reducing cross-talk in a contact assembly, comprising:

providing the contact assembly including a first pair of contact elements connected to a first pair of signal lines in a first connector, a second pair of contact elements connected to a second pair of signal lines in a second connector, a second contact element of the first pair of contact elements and a first contact element of the second pair of contact elements are positioned adjacent one another, and an electrical arrangement connecting a first contact element of the first pair of contact elements and the first contact element of the second pair of contact elements, the electrical arrangement includes a first portion extending from the first contact element of the first pair of contact elements and a second portion extending from the first contact element of the second pair of contact elements, the first portion overlaps the second portion in a direction extending parallel to an insertion direction of the contact elements; and compensating for a capacitance between the second contact element of the first pair of contact elements and the first contact element of the second pair of contact elements with a capacitance of the electrical arrangement.

* * * * *